US006698633B2

(12) United States Patent
Finkelstein

(10) Patent No.: US 6,698,633 B2
(45) Date of Patent: Mar. 2, 2004

(54) SHOULDER PAD

(76) Inventor: David Finkelstein, 1180 Ocean Pkwy., Apt. 3E, Brooklyn, NY (US) 11230

( * ) Notice: Subject to any disclaimer, the term of this patent is extended or adjusted under 35 U.S.C. 154(b) by 48 days.

(21) Appl. No.: 10/123,308

(22) Filed: Apr. 17, 2002

(65) Prior Publication Data

US 2002/0108979 A1 Aug. 15, 2002

Related U.S. Application Data

(63) Continuation-in-part of application No. 09/773,989, filed on Feb. 1, 2001.

(51) Int. Cl.[7] ..... A45F 3/12
(52) U.S. Cl. ..... 224/264
(58) Field of Search ..... 224/264; 2/268, 2/460

(56) References Cited

U.S. PATENT DOCUMENTS 925,828 A * 6/1909 Newton et al. ..... 24/511
2,633,573 A * 4/1953 Sanders ..... 2/460
2,640,993 A * 6/1953 Kleinman ..... 2/268
3,050,734 A * 8/1962 Dopyera ..... 224/264
3,153,791 A * 10/1964 White ..... 2/460
3,710,391 A * 1/1973 McGlynn ..... 2/460
4,062,065 A * 12/1977 Gardner ..... 2/271
4,879,768 A * 11/1989 McClees et al. ..... 224/264
4,887,318 A * 12/1989 Weinreb ..... 2/268
5,507,422 A * 4/1996 Shields ..... 224/264
5,590,826 A * 1/1997 Endo ..... 224/264

* cited by examiner

*Primary Examiner*—Gregory Vidovich
*Assistant Examiner*—Maerena W Brevard
(74) *Attorney, Agent, or Firm*—Bernard Malina; Malina & Wolson

(57) ABSTRACT

A relatively rigid body member is combined with a relatively soft pad member to form a shoulder pad. The pad member is mounted on a curved lower surface of the body member. The upper surface of the body member includes a slot which accepts a luggage strap and which is angled forwardly toward the lower surface. The curved lower surface accommodates the curvature of the user's shoulder while the pad member conforms to the individual user's shoulder anatomy. The upper and lower surfaces of the body member are formed in an angular relationship so that during use, the slot is always directed toward the user's shoulder so that the load exerted by the shoulder strap keeps the shoulder pad in place on the user's shoulder.

7 Claims, 7 Drawing Sheets

SHOULDER PAD

This application is a continuation-in-part of application Ser. No. 09/773,989 filed on Feb. 1, 2001.

FIELD OF THE INVENTION

The present invention relates generally to the field of luggage and equipment for carrying luggage and more particularly, to an improved shoulder pad.

BACKGROUND OF THE INVENTION

The prior art related to luggage and hand-carried equipment which includes various types of shoulder straps and shoulder pads which attempt to decrease the discomfort associated with carrying luggage or equipment by using a shoulder pad to distribute the load exerted by the weight of the equipment. Typically, conventional shoulder pads consist of a generally flat rectangular pad which is made of various types of rubber and a means for attaching the pad to a shoulder strap.

Conventional shoulder pads typically do not accomplish the goals of reducing the discomfort which results from the use of a shoulder strap. Conventional shoulder pads flex easily and do not adequately spread the load exerted on the shoulder of a user by the shoulder strap and thus do not adequately reduce the load per unit of area of contact between the shoulder pad and the user's shoulder. As a result, the conventional shoulder pad digs into the user's shoulder and severely limits both the load which can be carried and the length of time that the load can be carried before the degree of user discomfort becomes unacceptable.

In addition, a shoulder strap, when used with a conventional shoulder pad, tends to slide off the shoulder of a user. As a result, a user is forced to interrupt walking or other activity and continually readjust the position of the shoulder strap. This need for continuing periodic adjustment creates a degree of discomfort which further limits the utility of conventional shoulder pads.

SUMMARY OF THE INVENTION

It is an object of the present invention to provide a shoulder pad which effectively prevents the shoulder strap from digging into the shoulder of a user.

Another object of the present invention is to provide a shoulder pad which can be used with relatively heavy loads for projected periods of time.

Another object of the present invention is to provide a shoulder pad which prevents the shoulder strap from slipping off the shoulder of a user.

Another object of the present invention is to provide a high degree of comfort during use.

Another object of the present invention is to provide a shoulder pad which can be quickly and easily installed on a shoulder strap.

Yet another object of the present invention is to provide a shoulder pad which comprises a relatively small number of component parts which can be manufactured economically in volume resulting in a relatively low unit cost.

The foregoing and other objects and advantages of the invention will appear more clearly hereinafter.

In accordance with the present invention, a shoulder pad includes a relatively rigid body member and a relatively soft pad member. The pad member is mounted on a curved lower surface of the body member. The upper surface of the body member includes a slot which accepts a luggage strap and which is angled forwardly toward the lower surface. The curved lower surface accommodates the curvature of the user's shoulder while the pad member conforms to the individual user's shoulder anatomy. The upper and lower surfaces of the body member are formed in an angular relationship so that during use, the slot is always directed toward the user's shoulder so that the load exerted by the shoulder strap keeps the shoulder pad in place on the user's shoulder.

In an alternative embodiment of the invention, the body member is formed of a relatively flexible plastic material and includes a central portion which has an upper surface disposed at an angle relative to a lower surface. A pair of clip members facilitate attachment of the body member to a shoulder strap. During use, the shoulder strap extends over the upper surface of the central portion and under the clips with the angular central portion forcing the shoulder strap into the closed portion of the clips. The flexible body member bends to conform to the user's shoulder.

A relatively soft pad member is mounted on the lower surface of the body member. The pad member increases the comfort of the body member on the user's shoulder. A central portion of the pad member projects into an aperture which is formed in the central portion of the body member thereby aiding in locking the pad member and the body member together.

DESCRIPTION OF THE DRAWINGS

Other important objects and advantages of the invention will be apparent from the following detailed description, taken in connection with an accompanying drawing in which.

DETAILED DESCRIPTION OF THE INVENTION

Figure 1:
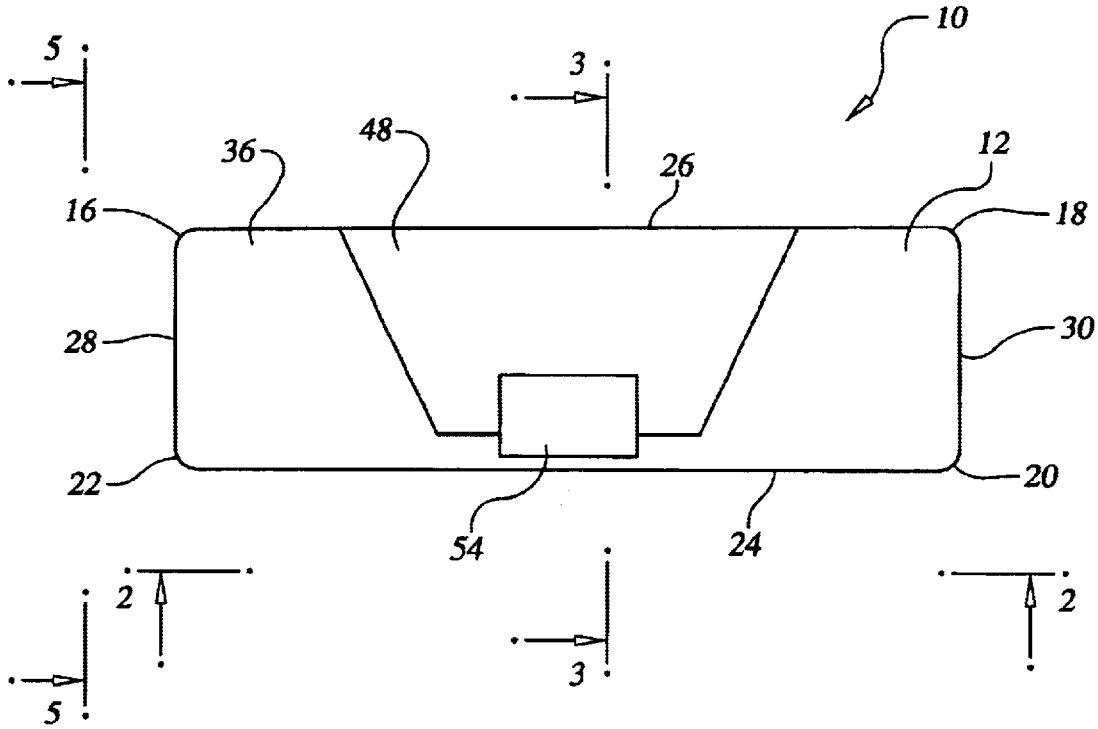
FIG. 1 is a top plan view of a shoulder pad made in accordance with the present invention.

With reference to the drawings, wherein like reference numbers designate like or corresponding parts throughout, there is shown in FIG. 1 a pad 10 for use with a shoulder strap 80 in carrying various types of luggage or other materials. The shoulder pad 10 includes a body member 12 and a pad member 14.

When viewed from the top as shown in FIG. 1, the shoulder pad 10 appears as a generally rectangular member with rounded corners 16, 18, 20, 22. The shoulder pad 10 is defined in part by a first longitudinal surface 24 (which is also defined as the inner surface), second longitudinal surface 26 (which is also defined as the outer surface), a first transverse surface 28 and a second transverse surface 30.

Figure 2:
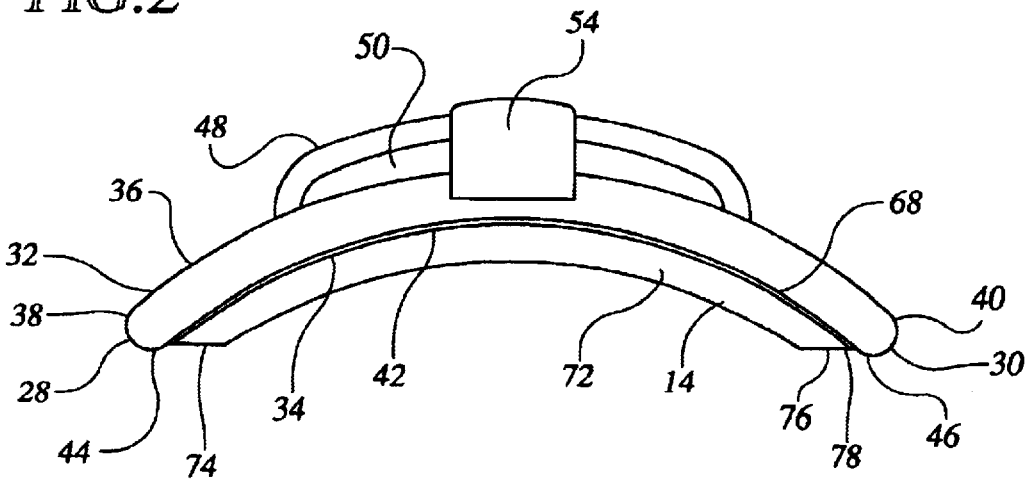
FIG. 2 is a front side elevation view of the shoulder pad of FIG. 1 taken along the line 2—2 of FIG. 1.

The body member 12 is further defined by an upper surface 32 and a lower surface 34. When viewed from the front, as is best shown in FIG. 2, the upper surface 32 and the lower surface 34 are each curved. The upper surface 32 includes a curved portion 36 which extends from the top portion 38 of the first traverse surface 28 to the top portion 40 of the second transverse surface 30. The lower surface 34 includes a curved portion 42 which extends from the bottom portion 44 of the first transverse surface 28 to the bottom portion 46 of the second transverse surface 30.

The body member 12 includes an integrally formed upper portion 48 which partially overlies the curved portion 36 as is shown in FIGS. 1 and 2. The upper portion 48 is spaced away from the curved portion 36 and, as a result, defines a slot 50 therebetween as is best shown in FIG. 3.

A key feature of the present invention will now be described with reference to FIG. 3. As is best known in FIG. 3, the height of the first longitudinal surface 24 is relatively large compared to the height of the second longitudinal surface 26. The shoulder pad 10 is thus relatively thicker at the outer surface 24 and relatively thinner at the inner surface 26. When the shoulder pad 10 is positioned as shown in FIG. 3, the slot 50 slopes downward and toward the left while the lower surface 34 slopes downward and toward the right. The advantages of the above construction as related to the operation of the present invention will be described presently.

Figure 3:
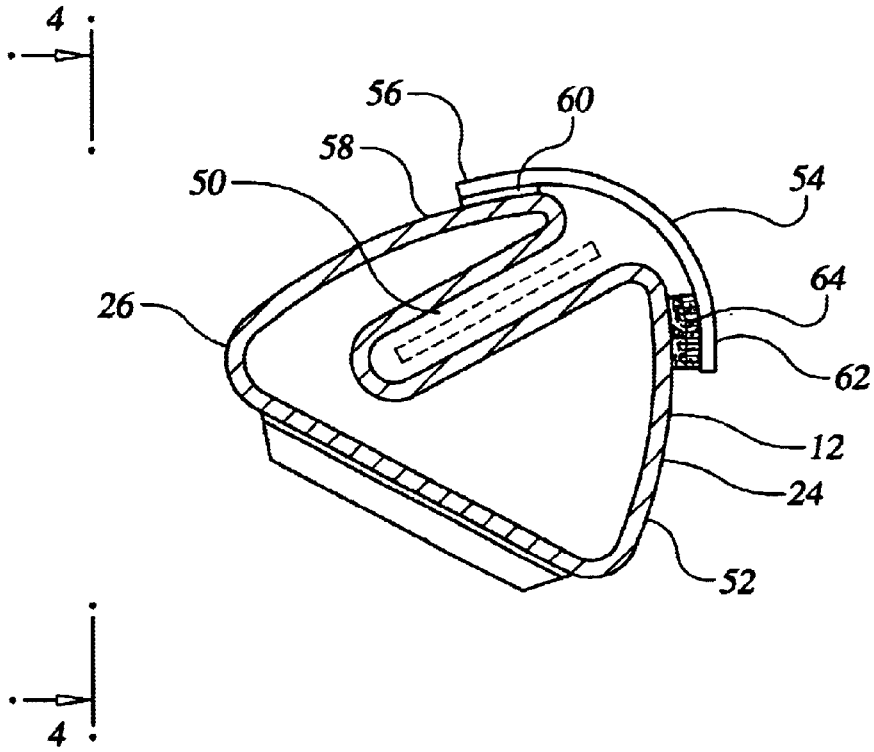
FIG. 3 is a cross-sectional view taken along the line 3—3 of FIG. 1 drawn to an enlarged scale.

As is shown in FIG. 3, the body member 12 is integrally formed into a hollow molded plastic member with a relatively thin continuous wall 52. The thin plastic wall combined with the various spacings and curvatures which have been described above results in a unit which is both light in weight and which is extremely stiff structurally.

A short flexible strap 54 has a first end 56 attached to a portion 58 of the upper portion 48 via an adhesive layer 60 and a second end which is removably attached to the body member 12 via a hook and loop fastener 64.

A relatively soft flexible pad member 14 is attached to the lower surface 34 of the body member 12 as is shown in FIGS. 2–5 via an adhesive layer 68. The edges 70, 72, 74, 76 of the pad member 66 are tapered such that the portion 78 of the pad member 66 closest to the lower surface 34 is relatively thin. This configuration facilitates the formation of a strongly bonded joint between the pad member 14 and the body member 12. The tapered edges 70, 72, 74, 76 prevent snagging or tearing of the pad member 66 during use. The pad is preferably constructed of a gel layer which combines the ability to conform to the surface of the body member 12 and to conform to the shoulder of a user.

Figure 4:
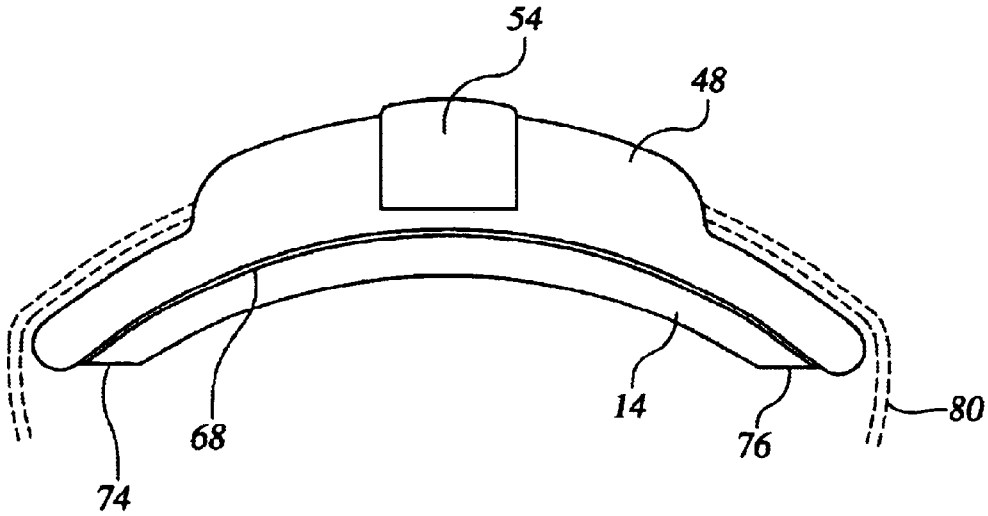
FIG. 4 is a rear elevation view taken along the line 4—4 of FIG. 3 with a luggage strap shown in broken lines.
Figure 5:
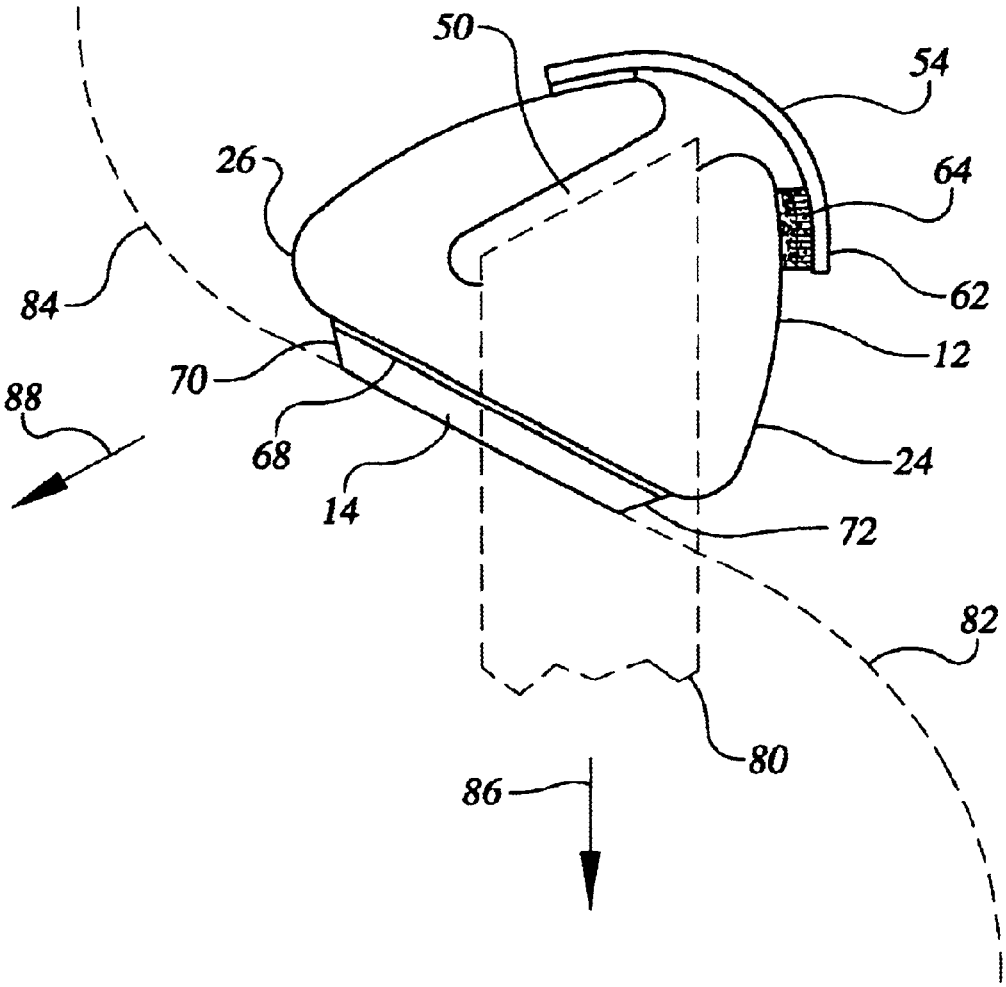
FIG. 5 is an end side elevation view taken along the line 5—5 of FIG. 1 with a luggage strap and the shoulder of a user shown in broken lines.

As is best shown in FIGS. 4 and 5 during use, a shoulder strap 80 of an item to be carried is slipped into the slot 50 and the end of the flexible strap 54 is attached to the body member 12. The shoulder pad 10 is placed on the user's shoulder 82 with the second longitudinal surface 26 of the shoulder pad positioned closest to the user's neck 84. The difference in height between first longitudinal surface 24 and the second longitudinal surface 26 compensates for the normal downward slope of the user's shoulder 82 as shown by the broken line 86 in FIG. 5. The slot 50 thus is maintained in a configuration wherein it slopes downward and toward the left. As a result of the weight of the luggage or other material being carried, shoulder strap 80 is forced under the influence of gravity to always slide downwardly and inwardly relative to the slot 50. The direction of the force exerted by the shoulder strap 80 is shown by the arrow 86 and the direction of the component of the force exerted by the shoulder strap 80 along the slot 50 is shown by the arrow 88. This force 88 is then directed inwardly relative to the user's body which urges the shoulder pad 10 to remain in place on the user's shoulder 82 and not slide off as in a conventional shoulder pad.

The rigid construction of the body member 12 enables the body member 12 to effectively spread the load of the shoulder strap 80. This reduces the load per unit area and enables the user to carry significant loads over long distances without discomfort.

The pad member 14 conforms to the user's body and accommodates the structure of the user's shoulder and promotes the comfort of the user.

The present invention thus provides a unique shoulder pad as a result of the combination of a relatively stiff and rigid specially-shaped body member 12 with a relatively soft and compliant pad member 14 and the formation of a slot for receiving a luggage strap. The angular relationship between the slot and the lower surface of the body member 12 ensures that the shoulder pad will not slide off the shoulder of a user.

Figure 6:
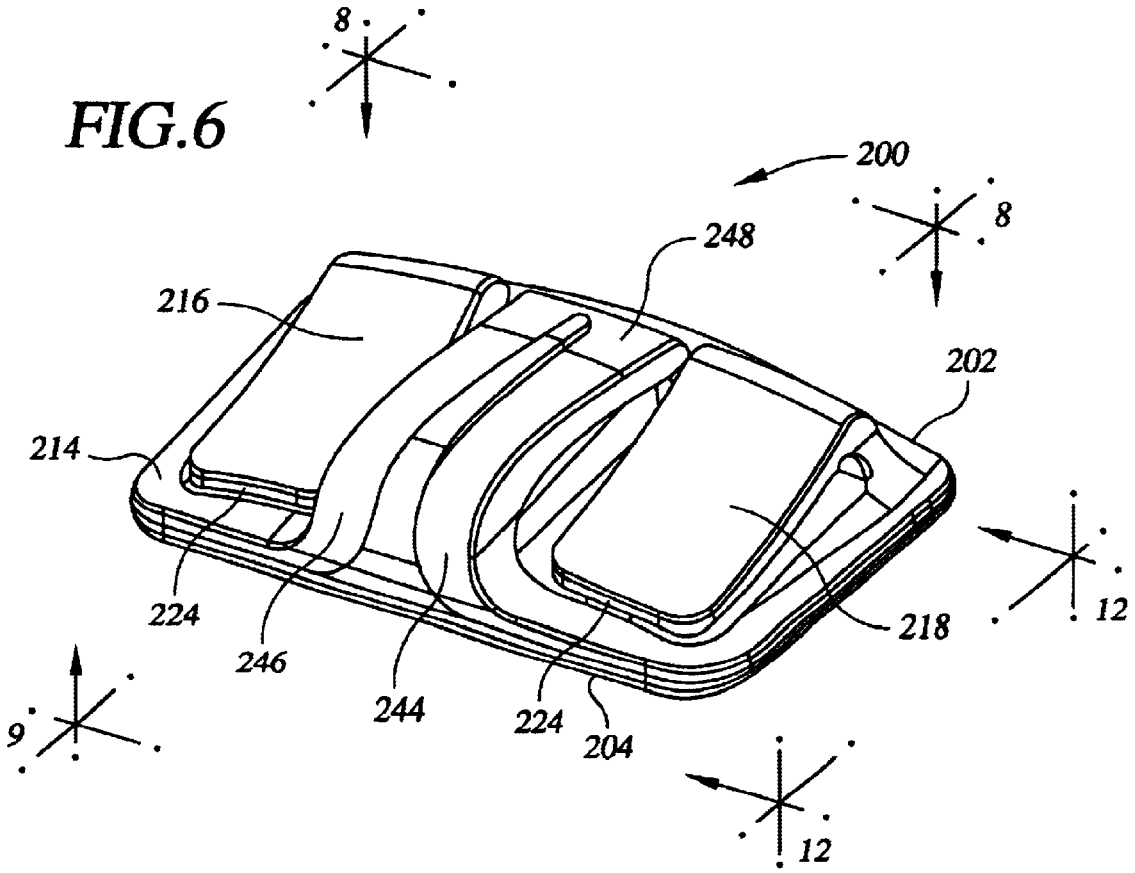
FIG. 6 is an overall top perspective view of an alternative embodiment of the shoulder pad of FIG. 1.

FIG. 6 shows an alternative embodiment 200 of the shoulder pad 10 of FIG. 1. The alternative embodiment 200 includes a body member 202 and a pad member 204. The body member 202 is generally rectangular when viewed from the top as in FIG. 8 or from the bottom as in FIG. 9. The body member 202 is defined by a generally straight first side edge 206, a generally convexly curved second side edge 208 and a pair of generally inwardly tapered end edges 210, 212.

Figure 7:
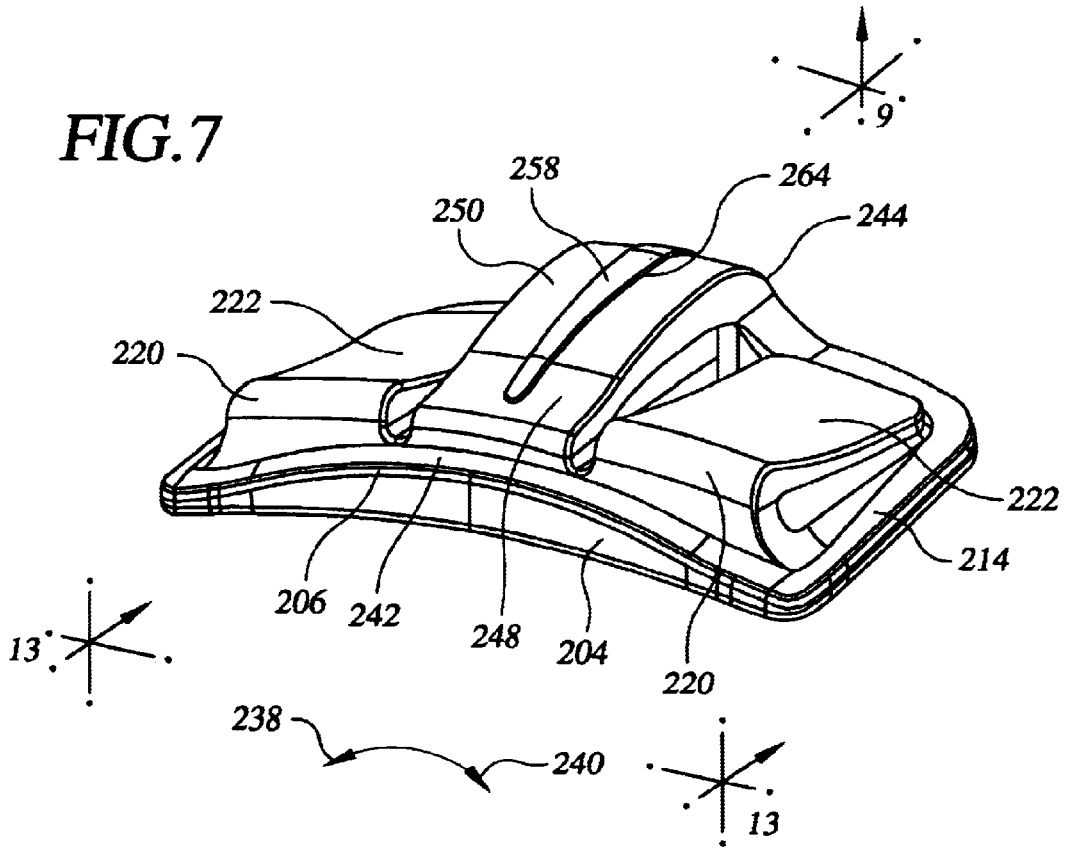
FIG. 7 is an overall top perspective view of the shoulder pad of FIG. 6 taken from an opposite direction relative to the view of FIG. 6.
Figure 12:
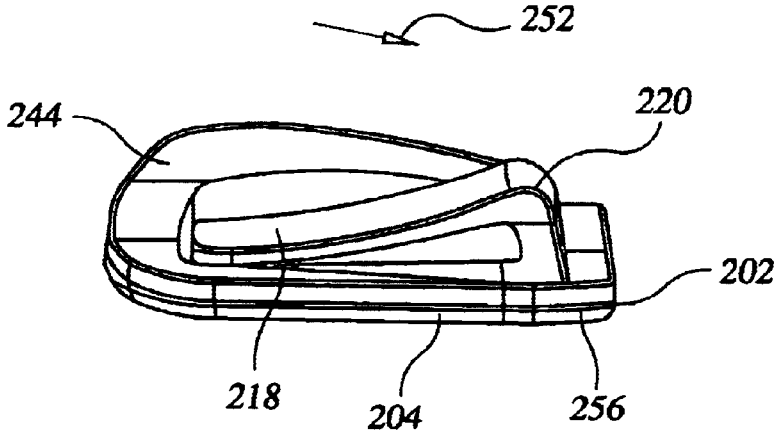
FIG. 12 is an end elevation view taken along the line 12—12 of FIG. 6.

The upper surface 214 of the body member 202 includes a pair of integrally formed clips 216, 218 which form a key feature of the present invention. As is best shown in FIGS. 6, 7 and 12, the clips 216, 218 each includes a first portion 220 which projects in a generally upward direction from the upper surface 214 of the body member 202. A second portion 222 projects in a generally downward direction toward the upper surface 214 of the body member 202. The ends 224 of the clips 216, 218 are disposed close to the upper surface 214 of the body member 202.

The body member 202 is made of a relatively flexible plastic material which enables the clips 216, 218 to flex to admit and retain a shoulder strap 226 under the clips 216, 218. The shoulder strap 226 is indicated for purposes of reference by the broken lines 228 indicated in FIG. 8.

The portions 230, 232 of the body member 202 adjacent to the clips 216, 218 define openings 234, 236. The openings 234, 236 which are thus defined by the portions 230, 232 of the body member 202 enable a shoulder strap 226 which has been inserted under the clips 216, 218 to flex into the openings 234, 236 and thus remain securely attached to the body member 202. In addition, the openings 234, 236 result in a reduction in the weight of the shoulder pad 200 and an increased degree of flexibility in the directions shown by the arrows 238, 240 in FIG. 7. During use, this flexibility allows the body member 202 to conform to the curvature of a user's shoulder and thus provides increased user comfort. When the shoulder pad 200 is not in use, the body member 202 returns to its generally flat configuration resulting in convenient storage.

The central portion 242 of the body member 202 includes an upwardly projecting portion 244 which forms another key feature of the present invention. As is best shown in FIGS. 6, 7 and 12, the upwardly projecting portion 244 has a relatively thicker portion 246 disposed relatively closer to the ends 224 of the clips 216, 218 and a relatively thinner portion 248 disposed closer to the portions 220 of the clips 216, 218. The upper surface 250 of the projecting portion 244 thus slopes in a downward direction toward the edge 206 of the body member 202.

As a result of the sloping surface 250 of the projecting portion 244, a shoulder strap 226 which has been placed under the clips 216, 218 and over the projecting portion 244 is held in an extremely secure manner. The shoulder strap when 226, loaded by an item being carried, will tend to slide in downward direction on the projecting portion 244 in the direction shown by the arrow 252 in FIG. 12. As the shoulder strap 226 moves in the direction shown by the arrow 252, the shoulder strap 226 is urged against the portions 220 on the clips 216, 218 and is thus retained securely on the body member 202. In addition, the slope of the projecting portion 244 of the body member 202 compensates for the natural slope of a user's shoulder as previously described in connection with FIG. 5 and prevents the shoulder strap 226 from slipping off the user's shoulder.

Figure 13:
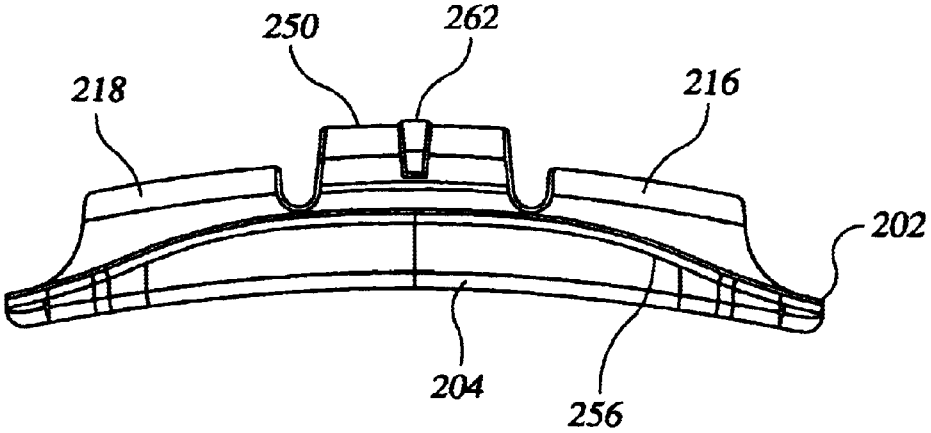
FIG. 13 is a side elevation view taken along the line 13—13 of FIG. 7.

The resilient pad member 204 is mounted on the lower surface 254 of the body member 202 by an adhesive layer 256. The pad member 204, which is made of a foam material or a soft rubber, conforms to the user's body and contributes toward the comfort of the user. The pad member 204 has an upwardly projecting portion 258 which projects upwardly into a slot 260 formed in the projecting portion 244 of the body member 202. The upper surface 262 of the projecting portion 258 projects slightly above the surface 250 of the projecting portion 244 as is shown in FIG. 13. The surface 262 of the pad member 204 has a relatively high coefficient of friction which helps hold the strap 226 in place when the shoulder pad 200 is in use.

Figure 8:
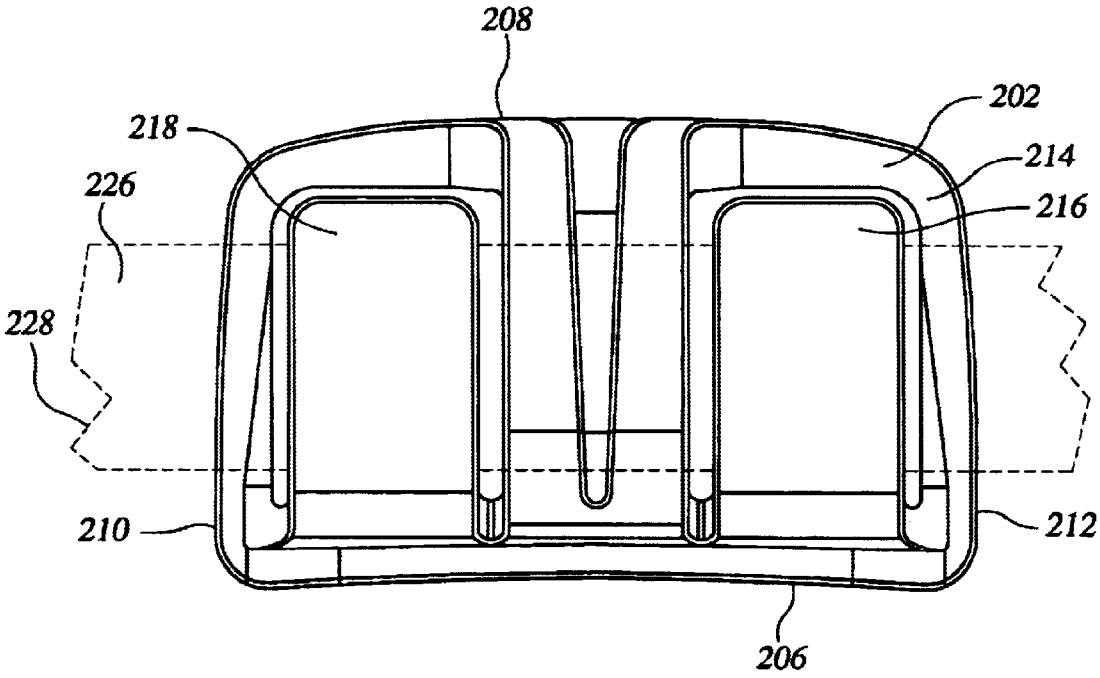
FIG. 8 is a top plan view of the shoulder pad of FIG. 6 taken along the line 8—8 of FIG. 6.
Figure 9:
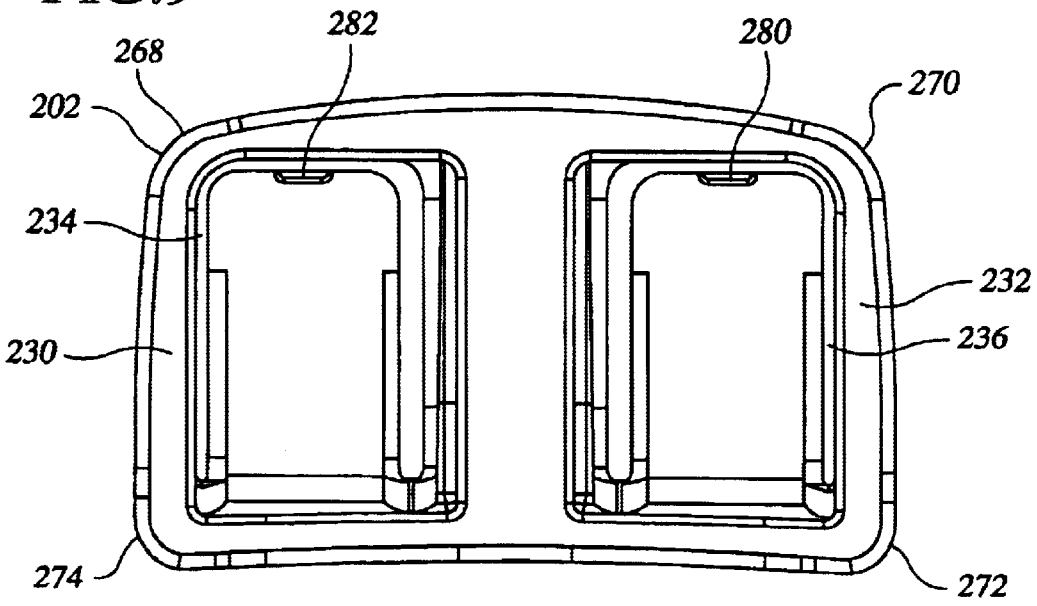
FIG. 9 is a bottom plan view of the shoulder pad of FIG. 6 taken along the line 9—9 of FIG. 6.

As is shown in FIGS. 6, 7 and 8, the projecting portion 258 is tapered and closely fits a complementary shaped opening 264 in the projecting portion 244.

The portion 264 of the pad 204 adjacent to edge 206 is relatively thicker than the portion 266 adjacent to the edge 208. This configuration aids in locking the resilient pad 204 and the body member 202 together. The corners 268, 270, 272, 274 of the body member 202 and the resilient pad 204 are curved thereby contributing toward the comfort of the user.

Figure 10:
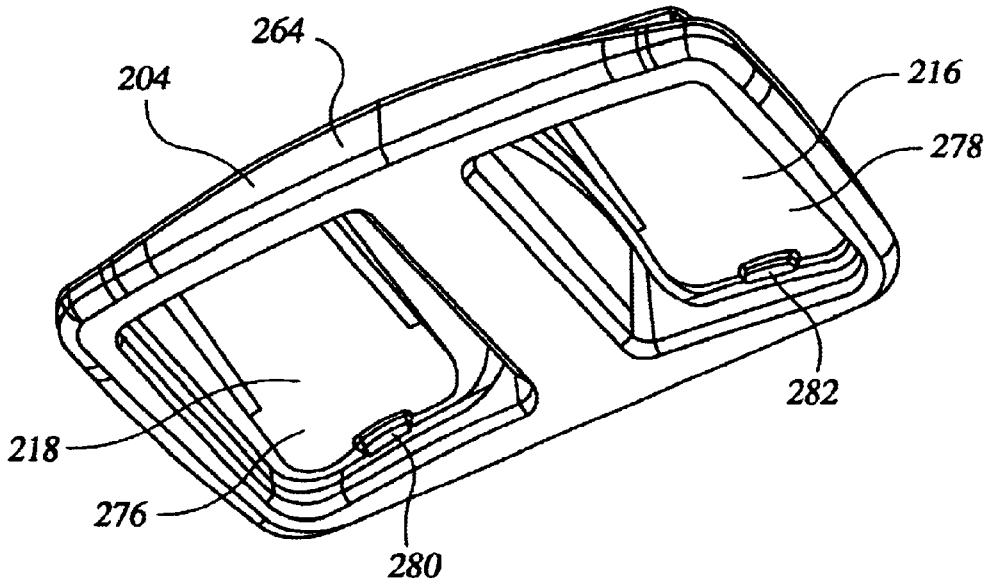
FIG. 10 is a bottom perspective view of the shoulder pad of FIG. 6.
Figure 11:
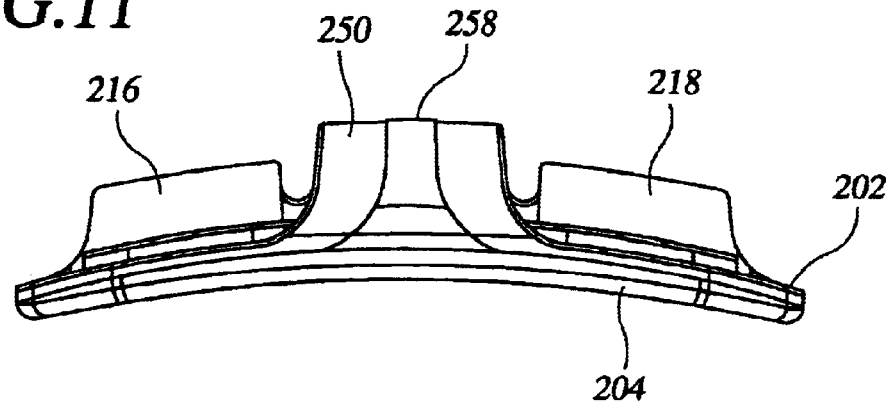
FIG. 11 is a side elevation view taken along the line 11—11 of FIG. 6.
Figure 14:
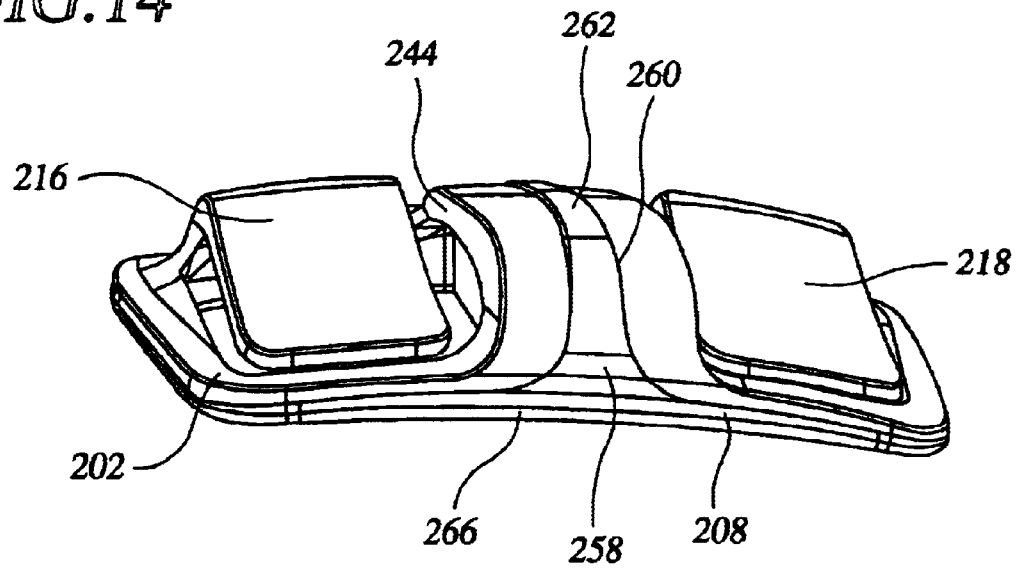
FIG. 14 is a side perspective view of the shoulder pad of FIG. 6.

As shown in FIG. 10, the lower portions 276, 278 of the clips 216, 218 include step portions 280, 282. The step portions 280, 282 aid in retaining the shoulder strap 226 on the shoulder pad 200.

The foregoing specific embodiments of the present invention as set forth in the specification herein are for illustrative purposes only. Various deviations and modifications may be made within the spirit and scope of the invention, without departing from a main theme therefor.

What is claimed is:

1. A shoulder pad for use with a shoulder strap comprising a body member having a first surface and a second surface with said first surface angularly disposed relative to said second surface, attachment means for attachment of said body member to said shoulder strap, said body member further comprising a third surface disposed below said second surface, a central portion with said central portion disposed on said second surface, with said first surface disposed on said central portion, a compliant layer with said compliant layer mounted on said third surface of said body member, said compliant layer comprising a projecting portion, and in which said central portion of said body member comprises an aperture, with said projecting portion projecting into said aperture.

2. The shoulder pad as claimed in claim 1 in which said attachment means comprise at least one means for clipping a strap, said means for clipping formed on said body member.

3. The shoulder pad as claimed in claim 1 in which said central portion is centrally disposed on said body member and in which said attachment means comprise a pair of means for clipping a strap, said means for clipping being formed on said member with said means for clipping disposed straddling said central portion.

4. The shoulder pad as claimed in claim 1 in which said body member is made of flexible material.

5. The shoulder pad as claimed in claim 1 in which said aperture has a wedge shape and in which said projecting portion has a wedge shape conforming to said aperture.

6. The shoulder pad as claimed in claim 1 in which said projecting portion of said compliant layer comprises an upper surface, with said upper surface projecting slightly above said first surface.

7. The shoulder pad as claimed in claim 1 which said body member and said attachment means are integrally formed as portions of a plastic molded member.

* * * * *